US007960963B1

(12) United States Patent
Zarr

(10) Patent No.: US 7,960,963 B1
(45) Date of Patent: Jun. 14, 2011

(54) METHOD AND APPARATUS FOR POWER CONTROL BY FREQUENCY SPREADING

(75) Inventor: Richard F. Zarr, Sanford, FL (US)

(73) Assignee: National Semiconductor Corporation, Santa Clara, CA (US)

( * ) Notice: Subject to any disclaimer, the term of this patent is extended or adjusted under 35 U.S.C. 154(b) by 490 days.

(21) Appl. No.: 12/122,465

(22) Filed: May 16, 2008

(51) Int. Cl.
*G05F 1/10* (2006.01)
*H05B 37/00* (2006.01)

(52) U.S. Cl. ..... 323/322; 323/905; 315/DIG. 4

(58) Field of Classification Search ..... 323/318–320, 323/322, 323, 905; 315/194, 291, 313–316, 315/DIG. 4
See application file for complete search history.

(56) References Cited

U.S. PATENT DOCUMENTS

| | | | | | |
|---|---|---|---|---|---|
| 4,241,295 | A | * | 12/1980 | Williams, Jr. | 315/294 |
| 4,287,468 | A | * | 9/1981 | Sherman | 323/322 |
| 5,675,221 | A | * | 10/1997 | Yoo et al. | 315/291 |
| 5,920,156 | A | * | 7/1999 | Carson et al. | 315/317 |
| 5,995,546 | A | | 11/1999 | Richardson | |
| 6,016,038 | A | | 1/2000 | Mueller et al. | |
| 6,586,890 | B2 | | 7/2003 | Min et al. | |
| 7,283,012 | B2 | | 10/2007 | Lim | |
| 2001/0045803 | A1 | * | 11/2001 | Cencur | 315/291 |
| 2006/0170370 | A1 | | 8/2006 | De Anna | |

OTHER PUBLICATIONS

Killat, Dirk et al., "Full Digital Dimming Regulation of Flourescent Lamps with -54 dB/Hz Light Ripple," IAS 2005, IEEE, 2747-2752.
"Pulse-density Modulation," Wikipedia, the free encyclopedia, 4 pages, http://en.wikipedia.org/wiki/Pulse-density_modulation (accessed Jan. 11, 2008).
"Trellis Modulation," Wikipedia, the free encyclopedia, 3 pages, http://en.wikipedia.org/wiki/Trellis_modulation (accessed Jan. 11, 2008).
Betten, John, "Reduce EMI by Sweeping A Power Supply's Frequency," Electronics Design, Strategy, News, May 2004, pp. 92,94 EDN.
Cho, Kyu-Min et al., "A Novel Average Burst-Duty Control Method for the Dimming of Induction Lamps," SPEEDAM 2006: International Symposium on Power Electronics, Electrical Drives, Automation and Motion, 2006, pp. S31-7-S31-12.
Sugimura, Hisayuki et al., "Single Reverse Blocking Switch Type Pulse Density Modulation Controlled ZVS Inverter with Boost Transformer for Dielectric Barrier Discharge Lamp Dimmer," IPEMC 2006, 2006 IEEE, 5 pages.
Raiser, Franz, "Dim the Lights: Problems with Lamp Current Control Using a PWM Signal," IEEE Industry Applications Magazine, Nov./Dec. 2002, 54-59.

* cited by examiner

*Primary Examiner* — Matthew V Nguyen

(57) ABSTRACT

A method and apparatus for providing a selected amount of power from a power source to a load produce a pseudo random code sequence of different type bits, in which one type of the different type bits is used to control application of power from the source to the load so that the power applied to the load corresponds to the total of the number of the bits of one type applied to the load in a given time period. A plurality of code sequences is provided, with each corresponding to a different power level, and a sequence can be selected to provide a selected power level to the load.

20 Claims, 2 Drawing Sheets

METHOD AND APPARATUS FOR POWER CONTROL BY FREQUENCY SPREADING

FIELD OF THE INVENTION

The present invention relates to control of power supplied to various devices such as LEDs using a frequency spreading technique.

BACKGROUND OF THE INVENTION

Various circuits are known to control the supply of power, voltage, and/or current to electrical devices such as light sources of the LED and incandescent type. The supply of power is controlled for various reasons, such as dimming the light output of the light source. One technique used to control dimming of these types of light sources is pulse width modulation (PWM). In implementing the PWM technique the power supply produces a pulse whose time duration (width) is controlled during a fixed period of time. This is done repetitively. The pulse width relative to the fixed time is referred to as the duty cycle. This is shown in FIG. 1 in which the repetitive fixed period is between time points A and B and the power pulse P can have a duty cycle time of any percentage of the time between these two points. When PWM is used to control the output of a light source, the rate or frequency of the fixed time period repetition is selected so that the light source is turned on and off at a rate high enough so that the thermal lag effect of the filament inside of an incandescent lamp bulb or the elements of an LED and the persistence of vision of a human integrate out so that the human eye cannot perceive the light source turn on and off or flicker.

In the control of the lighting devices using PWM, the longer the duration of the power pulse P (that is, the larger its duty cycle), the brighter the light output will be. For example, if the pulse duty cycle is 50% of the fixed time period, the source light output will be about 50% of its rated value or, conversely, dimmed by 50%. By selecting the pulse P duty cycle using PWM, the dimming of the light source can be controlled to any desired level.

While control of the light source output can be successfully accomplished using PWM, a significant disadvantage exists. This is due to the fact that repetitive production of the power pulse P is often at a frequency such that its harmonics can cause interference with the radio frequency spectrum. Accordingly, a need exists to be able to supply power to devices (such as light sources, as well as other devices) in a manner such that the output of the devices can be controlled (such as dimming of a light source output), but without having the problem of possibly producing interference with the radio frequency spectrum.

BRIEF DESCRIPTION OF THE INVENTION

In accordance with the invention, a method and apparatus are provided for producing output power in a variable manner to control various types of devices, such as light sources. The method and apparatus of the invention operate to control the total energy delivered to the device during a fixed time period in a pseudo random manner. In a preferred embodiment a pseudo random code is used to control the energy supplied to the device during a fixed time period. A binary type pseudo random code is defined as one that produces a series of one and zero bits in a random manner but is deterministic. In the invention, the pseudo random code is used so that when a one bit occurs the device is supplied power. Of course, the opposite approach can be used in that a zero bit will cause supply of power to the device. In operation, over a fixed time period or cycle, the pseudo random code will have a number of one bits whose total time of occurrence over a cycle will be equal to that of a duty cycle corresponding to the desired power output. For example, assuming that a light source such as an TED is being powered and a 50% light output or dimming is required, the number of one bits in the pseudo random code sequence will have a time duration that would correspond to the 50% duty cycle obtained using the PWM technique. The pseudo random code sequence is repeated over time at a rate such that there is no flicker perceived by the human. The invention can produce power output over a range corresponding to 0-100% by applying a pseudo random code sequence for each selected step within the range. For example, if the power output is to be selected in increments of 1%, there would be one hundred different pseudo random code sequences. Using PWM, this would correspond to different duty cycles from 1 to 100%. The different code sequences can be produced by algorithms that are stored in a memory (such as a ROM or read only memory) and then individually selected from the ROM and used to operate a circuit (such as a serial feedback shift register) that produces the one and zero bits that control the supply of the power to the device.

Supplying power in accordance with the invention significantly reduces or even eliminates the problem of interference with the radio frequency spectrum since the one bits that apply the power are normally spread out over the entire time of a power cycle and are of a shorter time duration than that of the single pulse produced using the PWM technique.

BRIEF DESCRIPTION OF THE DRAWINGS

Other objects and advantages of the present invention become more apparent upon reference to the following specification and annexed drawings in which.

DETAILED DESCRIPTION OF THE INVENTION

Figure 1:
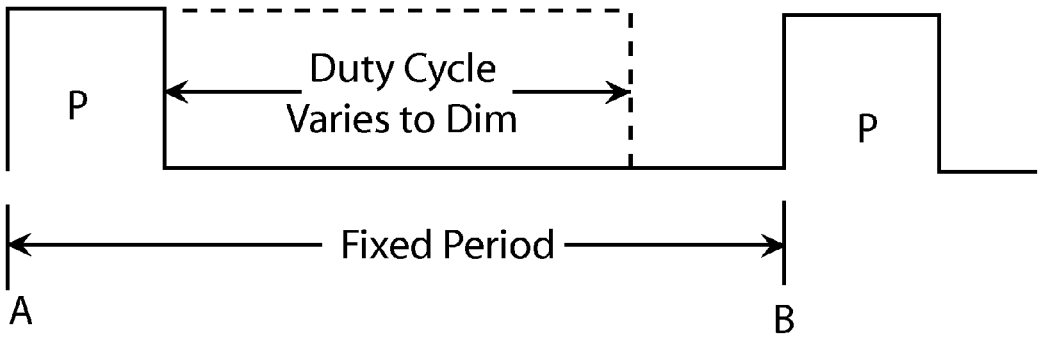
FIG. 1 is a drawing showing the application of the PWM technique.
Figure 2:
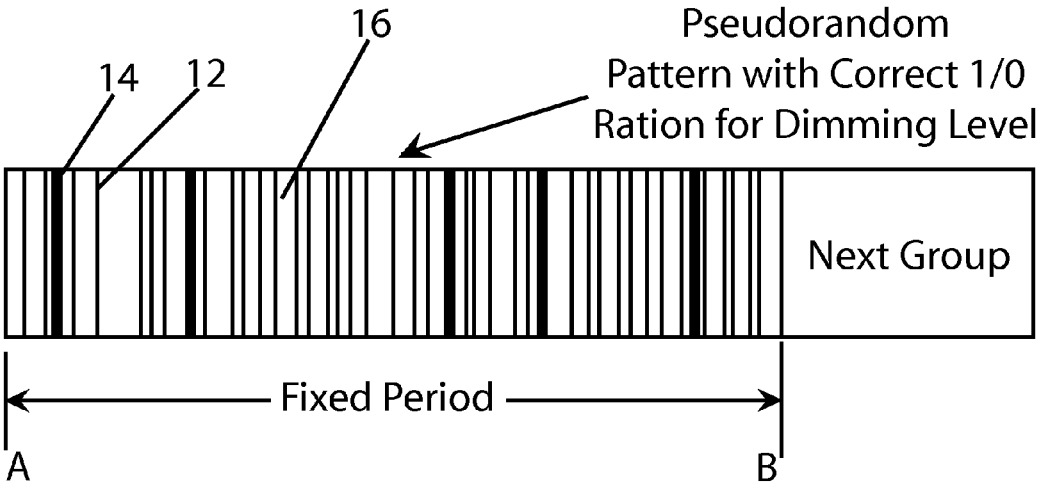
FIG. 2 is a drawing showing a typical pseudo random code sequence.

FIG. 2 shows a typical pseudo random code sequence that is produced by any suitable circuit, such as a shift register, during a fixed time period between the points A and B. In FIG. 2, the dark vertical bars 12 correspond to the one bits of the code. In the code sequence a number of one bits can be produced sequentially together, such as shown by the wider dark bar 14. The lighter color vertical bars 16 correspond to the zero bits of the code. The zero bit bars 16 also can be of different width depending upon the number of zero bits that are produced sequentially in the code. The basic idea is that the total number of one bits that occur within the fixed period when all grouped together would correspond in time to the amount of energy that is to be supplied to the device over the fixed time period. To consider it from another point of view, the ratio of the number of one bits in a code sequence to the number of zero bits sets the power level. For example, an equal number of one and zero bits during a cycle would produce a 50% power output level or 50% dimming where the device being controlled is a light source.

Different levels of power can be produced by selecting different codes. For example, if a power level of 60% is desired, then a code having 60% of one bits over a cycle would be selected. Different pseudo random codes can be produced using different algorithms as is well-known to a person of ordinary skill in the art. In one embodiment of the invention the code sequences can be stored in a ROM and selected depending upon the output power that is desired. For example, if there are to be one hundred selectable levels of power, then that would be one hundred different pseudo random codes. The degree of power level selection can be made as fine or coarse as desired by providing more or fewer of the different code sequences.

The code sequence is repeated at a rate high enough to satisfy the power delivery application. For example, if the device that is supplied the power is a light source, the repetition rate, or frequency, of the code sequence is made sufficiently high so that there will be no flicker of the light. Considering that the light source to be supplied the power is an LED, a repetition frequency of about 30 KHz appears to be acceptable.

Figure 3:
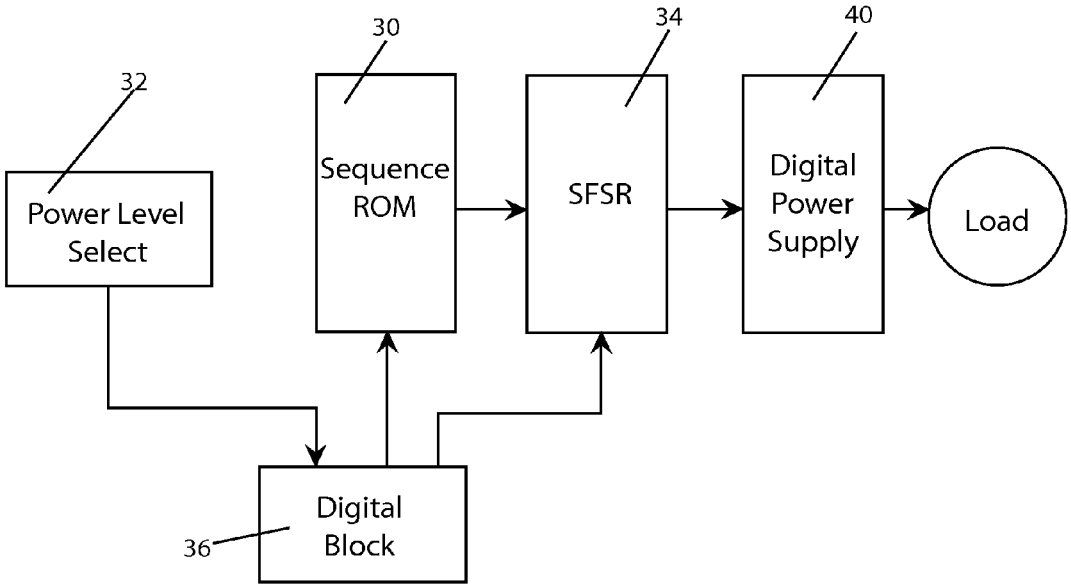
FIG. 3 is a schematic diagram of a circuit showing operation of a device using the frequency spreading technique of the invention.

FIG. 3 shows a circuit for carrying out the principles of the invention in supplying power to a load. There is a sequence ROM 30 having sufficient memory capacity in which the various code sequences are stored. A power level selector device 32 selects the level of power to be provided to the load by selecting the code sequence from the ROM 30 corresponding to the desired power level. The output data of the code sequence read out from the ROM 30 is supplied to a circuit 34, such as a serial feedback shift register (SFSR), that converts this data into the one and zero bits. Any other suitable conventional circuit can be used for producing the one and zero bits. The ROM 30, the power level select circuit 32, and the bit producing circuit 34 are shown connected to a digital block 36 which can be, for example, a sequencer or embedded processor. The level selector 32 is illustratively shown as providing an input to the digital block 36 to be used to select and control the repetition frequency of the selected code sequence, but it also could be part of the digital block 36. It is preferred that dedicated digital logic be used to control the entire circuit to reduce the size of the integrated circuit and thus the cost.

The output bits of the selected code sequence from the circuit 34 are supplied to the modulation input of a digitally controlled power supply 40. The power supply 40 turns on and off in response to the modulation input and is designed to provide either constant current or constant voltage depending on the requirements of the load when on. The output of the power supply 40 is connected to the load and, by repetitive application of the bits from the selected code sequence, the load is supplied power at the level corresponding to the selected pseudo random code sequence.

The load can be any type of device to whose input the power level is to be selected and controlled in order to control its output or operation. For example, the load can be one or more incandescent lamps or one or more LEDs. Here, selection and control of the input power controls the light output. The load also can be a motor, such as those used for operating hand tools like drills and saws to control operating speed. Particular utility is found with respect to control of LEDs, which are finding increasing use when a number are assembled together to be used as a light source, used for backlighting of an electronic device such as an LED television receiver display, lighting for the control panel of an automobile or aircraft, heaters or Peltier thermoelectric coolers that are used in many different applications including electronics, etc.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

I claim:

1. An apparatus for providing a selected amount of power to a load, comprising:

a first circuit configured to provide a pseudo random code sequence containing different types of bits; and a second circuit configured to apply the selected amount of power to the load based on a specified one of the different types of bits in the pseudo random code sequence;

wherein the first circuit is configured to provide the pseudo random code sequence on a repetitive basis at a repetition frequency; and wherein the first circuit comprises a selector configured to, in response to receiving a desired power level, select both the pseudo random code sequence and the repetition frequency.

2. The apparatus of claim 1, wherein a total number of bits of the specified type corresponds to the desired power level.

3. The apparatus of claim 2, wherein the first circuit is configured to provide a plurality of different pseudo random code sequences, each sequence corresponding to a different power level to be applied to the load.

4. The apparatus of claim 3, wherein the first circuit comprises a memory configured to store data defining the plurality of different code sequences.

5. The apparatus of claim 4, wherein the first circuit comprises a circuit configured to produce the bits of the code sequences based on the data from the memory.

6. The apparatus of claim 1, wherein:

the first circuit is configured to provide a plurality of different pseudo random code sequences; and the selector is configured to select the repetition frequency at which each of the pseudo random code sequences is provided.

7. The apparatus of claim 1, wherein the second circuit comprises a power supply configured to be connected to the load with a modulation input coupled to the first circuit, the first circuit configured to turn an output of the power supply on and off based on the pseudo random code sequence.

8. The apparatus of claim 1, wherein:

the load is a light source; and the second circuit is configured to select the selected amount of power to control a dimming of a light output of the light source.

9. A method for providing a selected amount of power from a power source to a load, comprising:

producing a pseudo random code sequence containing different types of bits; and applying the selected amount of power from the power source to the load in response to a specified one of the different types of bits in the pseudo random code sequence;

wherein the pseudo random code sequence is provided on a repetitive basis at a repetition frequency; and wherein the method further comprises selecting, in response to receiving a desired power level, both the pseudo random code sequence and the repetition frequency.

10. The method of claim 9, wherein a total number of bits of the specified type corresponds to the desired power level.

11. The method of claim 10, wherein the producing step comprises producing a plurality of different pseudo random code sequences, each sequence corresponding to a different power level to be applied to the load.

12. The method of claim 11, further comprising the step of:

storing data defining the plurality of different code sequences in a memory.

13. The method of claim 12, wherein the producing step comprises producing the bits of the code sequences based on the stored data.

14. The method of claim 9, wherein:

producing the pseudo random code sequence comprises producing a plurality of different pseudo random code sequences; and the method further comprises the step of selecting the repetition frequency at which each of the pseudo random code sequences is produced.

15. The method of claim 9, further comprising the steps of:

providing the bits of the pseudo random code sequence to a modulation input of a digitally controlled power supply; and turning an output of the digitally controlled power supply on and off based on the bits of the pseudo random code sequence.

16. The method of claim 9, wherein:

the load is a light source; and selecting the amount of power controls a dimming of a light output of the light source.

17. A system comprising:

a light source; and an apparatus configured to provide a selected amount of power to the light source, the apparatus comprising:

a first circuit configured to provide a pseudo random code sequence containing different types of bits; and a second circuit configured to apply the selected amount of power to the light source based on a specified one of the different types of bits in the pseudo random code sequence;

wherein the first circuit is configured to provide the pseudo random code sequence on a repetitive basis at a repetition frequency; and wherein the first circuit comprises a selector configured to, in response to receiving a desired power level, select both the pseudo random code sequence and the repetition frequency.

18. The system of claim 17, wherein:

the first circuit is configured to provide a plurality of different pseudo random code sequences associated with different desired power levels; and the selector is configured to select the repetition frequency at which each of the pseudo random code sequences is provided.

19. The system of claim 17, wherein the second circuit comprises a power supply connected to the light source and having a modulation input coupled to the first circuit, the first circuit configured to turn an output of the power supply on and off based on the pseudo random code sequence.

20. The system of claim 17, wherein the light source comprises one or more light emitting diodes.

* * * * *